US007753460B2

(12) United States Patent
Peng et al.

(10) Patent No.: US 7,753,460 B2
(45) Date of Patent: Jul. 13, 2010

(54) MULTI-SECTION SLIDE ASSEMBLY

(75) Inventors: Wen-Tang Peng, Taipei Hsien (TW); Mo-Ming Yu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 480 days.

(21) Appl. No.: 11/750,346

(22) Filed: May 18, 2007

(65) Prior Publication Data

US 2007/0296318 A1 Dec. 27, 2007

(30) Foreign Application Priority Data

Jun. 23, 2006 (CN) ..... 2006 1 0061303

(51) Int. Cl.
*A47B 88/04* (2006.01)

(52) U.S. Cl. ..... 312/334.46; 312/334.47

(58) Field of Classification Search ..... 312/330.1, 312/334.1, 334.7, 334.8, 334.11, 334.44, 312/334.46, 334.47, 333; 384/18, 21, 22
See application file for complete search history.

(56) References Cited

U.S. PATENT DOCUMENTS 3,650,578 A * 3/1972 Del Vecchio et al. ..... 384/18
6,450,600 B1 * 9/2002 Chen et al. ..... 312/334.46
6,585,335 B2 7/2003 Hwang et al.
6,655,763 B2 * 12/2003 Judge et al. ..... 312/334.46
6,899,408 B2 5/2005 Chen et al.
6,997,611 B2 2/2006 Chen et al.
7,118,277 B2 * 10/2006 Chen et al. ..... 384/21
7,520,577 B2 * 4/2009 Chen et al. ..... 312/334.46

* cited by examiner

*Primary Examiner*—James O Hansen
(74) *Attorney, Agent, or Firm*—Frank R. Niranjan

(57) ABSTRACT

A multi-section slide assembly includes an outer slide, an intermediate slide, an inner slide, a positioning member, and an actuating member. The outer slide forms a locking tab. The intermediate slide is received in the outer slide. The intermediate slide defines two receiving slots and at least one slit. The positioning member is mounted to the intermediate slide, and includes at least one positioning tab extending downward therefrom. The positioning tab extends through the slit and abuts against the locking tab. The actuating member is mounted between the intermediate member and the positioning member. The actuating member forms two arms. Two arrises protrude downward from the arms of the actuating member and extend through the corresponding receiving slots of the intermediate slide. The inner slide is received in the intermediate slide. The inner slide is capable of being slid in to depress the arms of the actuating member to tilt the actuating member, whereby the positioning tab is lifted up to disengage from the locking tab.

16 Claims, 5 Drawing Sheets

MULTI-SECTION SLIDE ASSEMBLY

BACKGROUND OF THE INVENTION

1. Field of the Invention

The present invention relates to multi-section slide assemblies, and particularly to a multi-section slide assembly having a positioning device for positioning an intermediate slide thereof.

2. Description of related art

A slide assembly is usually used to connect and guide two articles that may be moved relative to each other, such as a cabinet and a server or a cupboard and a drawer. A conventional three-section slide assembly generally comprises an outer slide, an intermediate slide, and an inner slide. For example, the outer slide may be fixed in a cabinet, the inner slide may be fixed at two sides of the drawer of the cabinet, and the intermediate slide is received in the outer slide to support the inner slide. The inner slide, the intermediate slide, and the outer slide may be coupled with each other by the use of ball bearings, and the inner slide and the intermediate slide may be moved in the axial direction of the outer slide. Thus, the drawer may be pulled outward from or pushed inward to the cabinet freely by use of the slide assembly. However, the intermediate slide may be inadvertently slid along an undesired direction and possibly pinch or trap a user's finger.

What is desired, therefore, is a slide assembly having a positioning device for its intermediate slide.

SUMMARY OF THE INVENTION

An exemplary multi-section slide assembly includes an outer slide, an intermediate slide, an inner slide, a positioning member, and an actuating member. The outer slide forms a locking tab. The intermediate slide is received in the outer slide. The intermediate slide defines two receiving slots and at least one slit. The positioning member is mounted to the intermediate slide, and includes at least one positioning tab extending downward therefrom. The positioning tab extends through the slit and abuts against the locking tab. The actuating member is mounted between the intermediate member and the positioning member. The actuating member forms two arms. Two arrises protrude downward from the arms of the actuating member and extend through the corresponding receiving slots of the intermediate slide. The inner slide is received in the intermediate slide. The inner slide is capable of being slid in to depress the arms of the actuating member to tilt the actuating member, whereby the positioning tab is lifted up to disengage from the locking tab.

Other advantages and novel features of the present invention will become more apparent from the following detailed description of preferred embodiment when taken in conjunction with the accompanying drawings, in which:

DETAILED DESCRIPTION OF THE INVENTION

Figure 1:
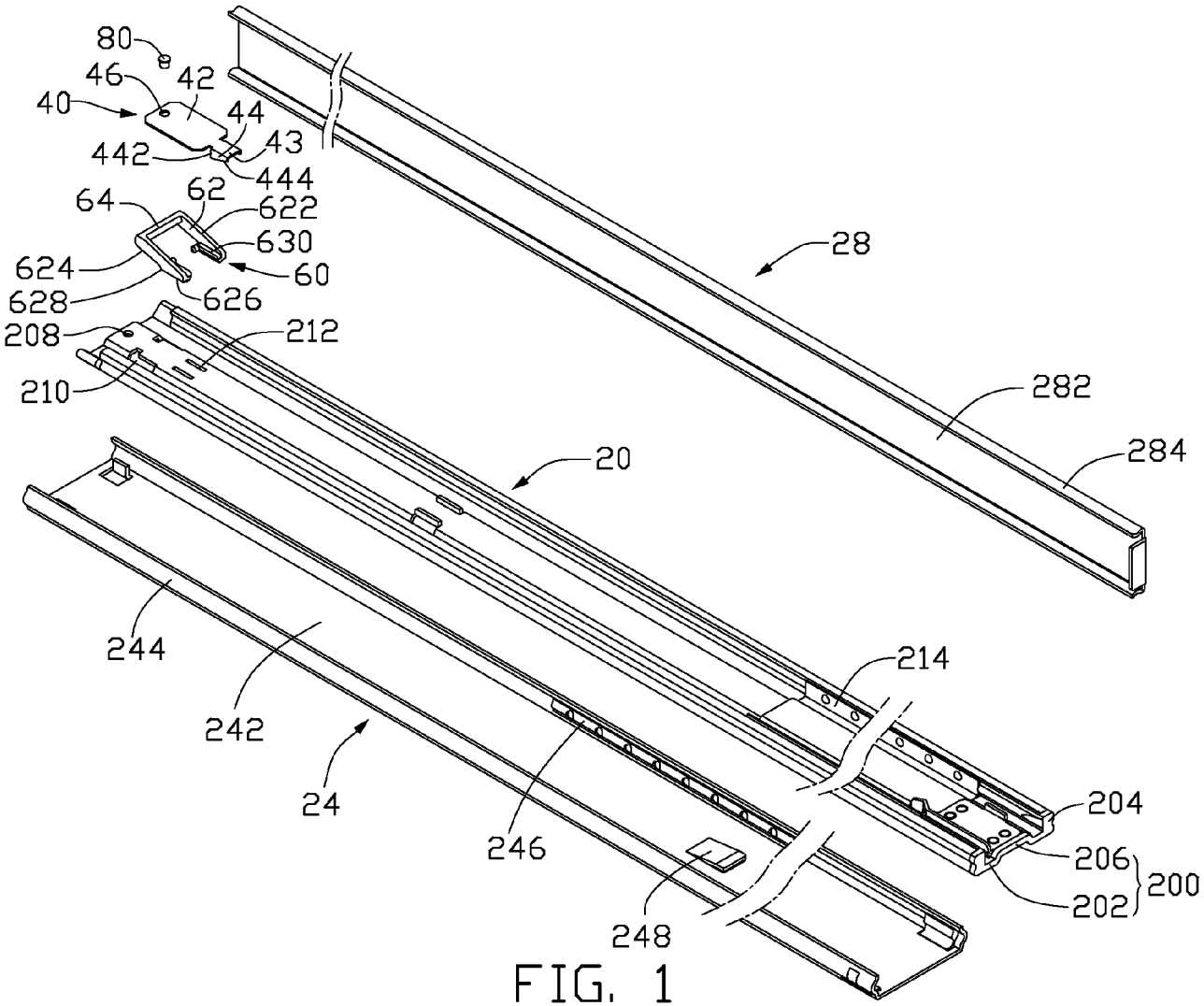
FIG. 1 is an exploded, isometric view of a multi-section slide assembly in accordance with a preferred embodiment of the present invention with a positioning member and an actuating member.
Figure 2:
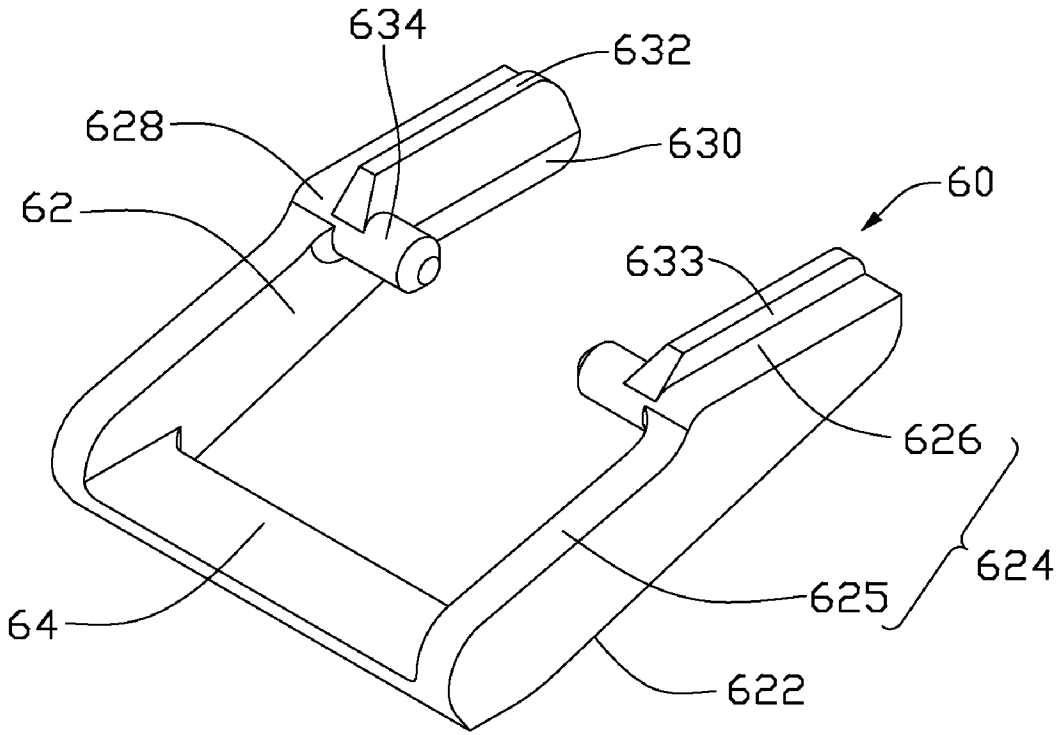
FIG. 2 is an enlarged view of the actuating member of FIG. 1, but viewed from another aspect.

Referring to FIGS. 1 and 2, a multi-section slide assembly in accordance with a preferred embodiment of the present invention is shown. The multi-section slide assembly includes an outer slide 24, an intermediate slide 20, an inner slide 28, and a positioning device for positioning the intermediate slide 20 relative to the inner slide 28. The positioning device includes a positioning member 40, and an actuating member 60.

The positioning member 40 includes a rectangular plate 42, and a tongue 43 extending from a front end of the plate 42. Two triangular positioning tabs 44 extend downward from two sides of the tongue 43, respectively. Each positioning tab 44 includes a straight side 442 perpendicular to the tongue 43, and a sloping side 444. A through hole 46 is defined in a rear end of the plate 42.

The actuating member 60 includes two arms 62, and a bridge 64 connecting rear ends of the two arms 62. Thus, the actuating member 60 has a U-shaped configuration. Each arm 62 forms an inclined upper surface 622, and a bottom surface 624. The bottom surface 624 forms an abutting portion 626 and a tilted portion 625. The abutting portion 626 includes an arcuate end 628 connecting to the tilted portion 625. Two blocks 630 are respectively formed adjacent the abutting portions 626 and extend toward each other. An arris 632 protrudes downward from each block 630. Each arris 632 includes a sidewall 633 adjacent and perpendicular to the corresponding abutting portion 626. A pivot 634 is formed on an end of each block 630, adjacent the arcuate end 628 of the corresponding abutting portion 626. The pivots 634 extend toward each other.

The intermediate slide 20 has a substantially U-shaped cross-section, and includes a web 200, and two arms 204 respectively extending from two lateral edges of the web 200. The web 200 and the arms 204 cooperatively define a receiving space. The web 200 includes a bulge plate 206 and two recessed lateral sides 202. The bulge plate 206 defines a fixing hole 208, two L-shaped receiving slots 210, and two slits 212 therein. The fixing hole 208 is defined in a rear end of the bulge plate 206, corresponding to the through hole 46 of the positioning member 40. The receiving slots 210 are respectively defined in two sides of the bulge plate 206, adjacent the fixing hole 208. The slits 212 are adjacent the receiving slots 210, and respectively correspond to the positioning tabs 44 of the positioning member 40. A slide-aiding member 214 is slidably received in the intermediate slide 20, for facilitating the sliding movement of the inner slide 28 relative to the intermediate slide 20.

The outer slide 24 has a substantially U-shaped cross-section, and includes a web 242, and two arms 244 respectively extending from two lateral edges of the web 242. The web 242 and the arms 244 cooperatively define a receiving space for receiving the intermediate slide 20. Two or more slide-aiding members 246 are slidably mounted between the outer slide 24 and the intermediate slide 20, for facilitating the sliding movement of the intermediate slide 20 relative to the outer slide 24. A cantilever sloping locking tab 248 is formed on the web 242, at a proper distance from a rear end of the web 242. The locking tab 248 extends into the receiving space defined by the web 242 and the arms 244.

The inner slide 28 has a substantially U-shaped cross-section, and includes a web 282, and two arms 284 respectively extending from two lateral edges of the web 282. The inner slide 28 is slidably received in the receiving space of the intermediate slide 20. The slide-aiding member 214 is slidably sandwiched between the intermediate slide 20 and the inner slide 28, for facilitating the sliding movement of the inner slide 28.

Figure 3:
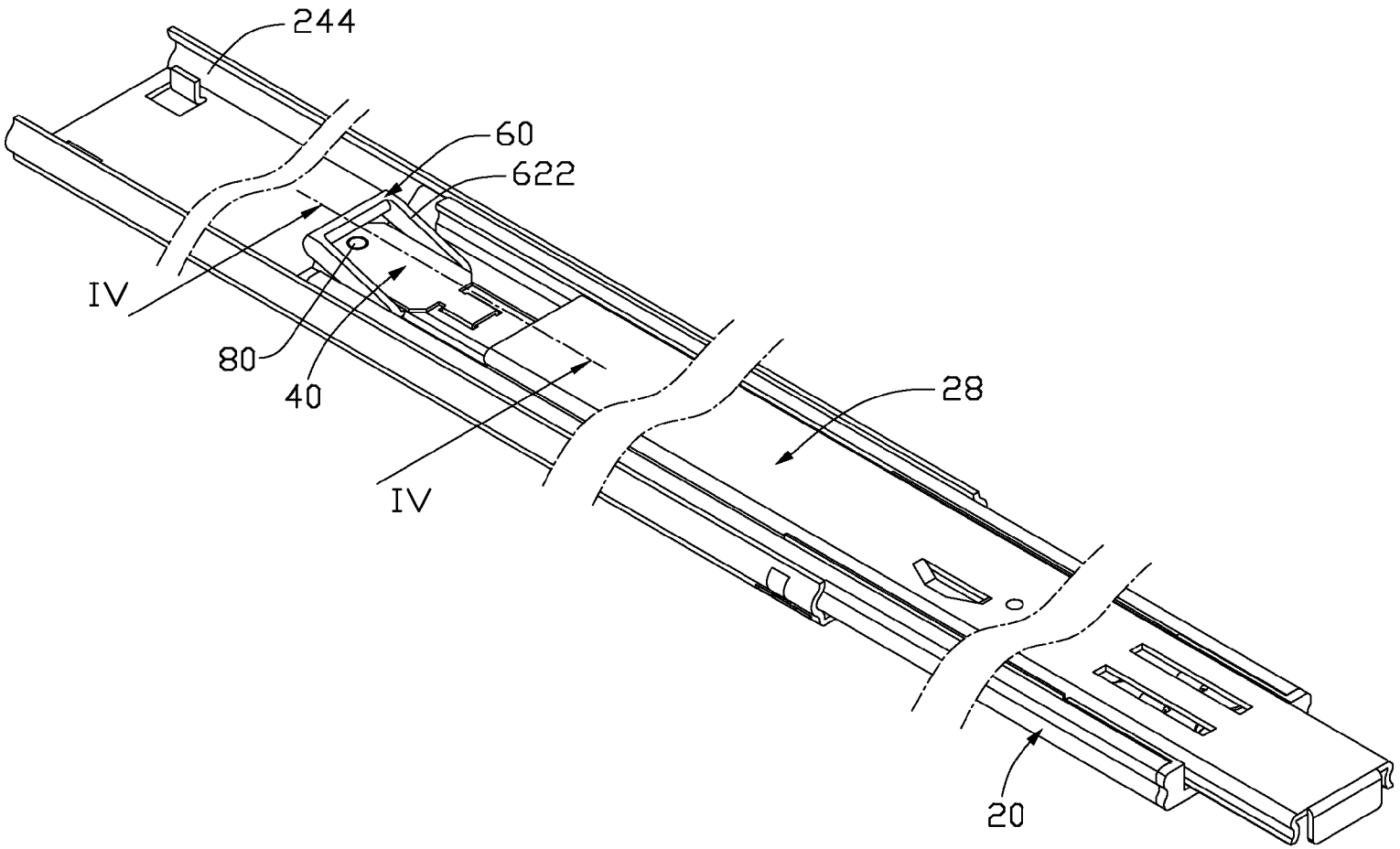
FIG. 3 is an assembled view of FIG. 1.
Figure 4:
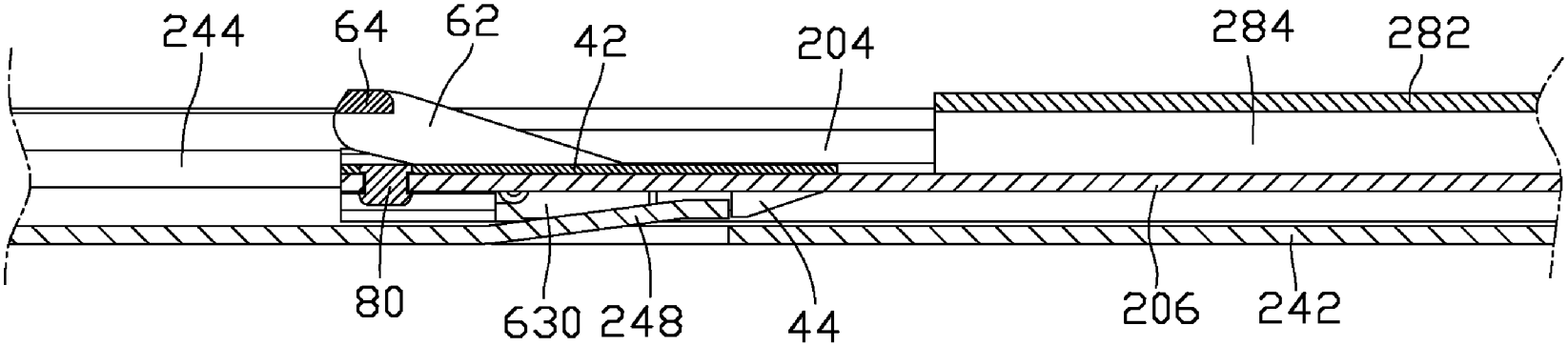
FIG. 4 is a cross-sectional view taken along line IV-IV of FIG. 3, showing the positioning member at a locked position.

Referring to FIGS. 3 and 4, in assembly, the pivots 634 and the blocks 630 of the actuating member 60 are received in the corresponding receiving slots 210 of the intermediate slide 20. The arrises 632 of the actuating member 60 extend through the corresponding receiving slots 210 of the intermediate slide 20, and the arrises 632 and the bridge 64 are at opposite sides of the web 200 of the intermediate slide 20. The abutting portions 626 and the sidewalls 633 of the arrises 632 abut against the corresponding lateral sides 202 of the intermediate slide 20, to prevent movement of the actuating member 60 in a direction perpendicular to the bulge plate 206. The plate 42 extends through a space between the two arms 62 of the actuating member 60, and abuts against the bulge plate 206 of the intermediate slide 20, the blocks 630, and the pivots 634 of the actuating member 60. The positioning tabs 44 of the positioning member 40 extend through the corresponding slits 212 of the intermediate slide 20. A rivet 80 extends through the through hole 46 of the positioning member 40, and is inserted into the fixing hole 208 of the intermediate slide 20 to engage with the intermediate slide 20, whereby the positioning member 40 is fixed to the rear end of the intermediate slide 20. The pivots 634 can prevent movement of the actuating member 60 along a longitudinal direction of the intermediate slide 20.

The rear end of the intermediate slide 20 is inserted into the front end of the outer slide 24. A front end of the intermediate slide 20 is pushed inward, thereby the intermediate slide 20 is received in and slides rearward along the outer slide 24. When the straight sides 442 of the positioning tabs 44 of the positioning member 40 abut against the distal end of the locking tab 248 of the outer slide 24, the intermediate slide 20 cannot be pushed further rearward along the outer slide 24. A rear end of the inner slide 28 is inserted into the front end of the intermediate slide 20. A front end of the inner slide 28 is pushed inward, thereby the inner slide 28 is received in, and slides into, the intermediate slide 20.

Figure 5:
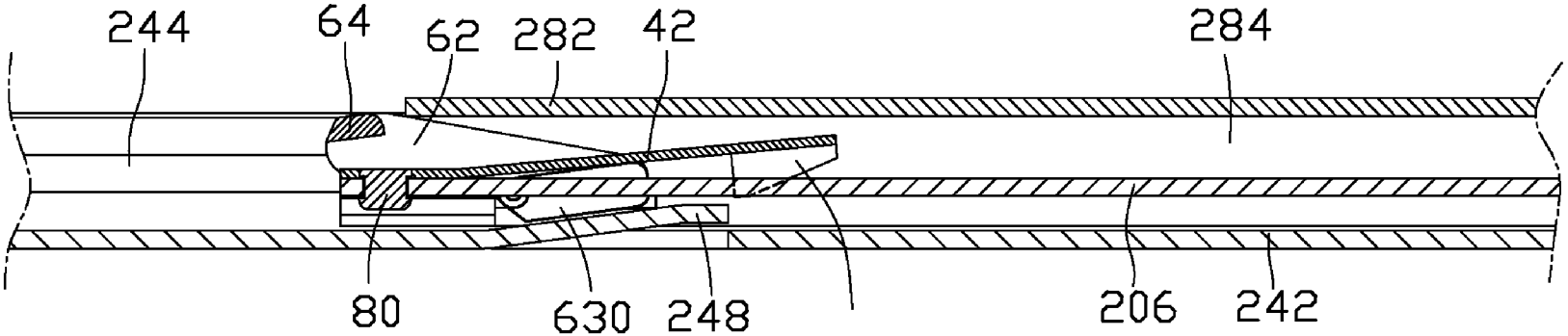
FIG. 5 is similar to FIG. 4, but showing the positioning member at an unlocked position.

Referring to FIG. 5, the rear end of the web 282 of the inner slide 28 slides along the inclined upper surfaces 622 of the arms 62 of the actuating member 60, and presses down the arms 62 of the actuating member 60. The actuating member 60 pivots around the arcuate ends 628. The blocks 630 lift the portion of the plate 42 away from the rivet 80 up. When the rear end of the web 282 rides on the bridge 64 of the actuating member 60, the positioning tabs 44 of the positioning member 40 are lifted up to disengage from the locking tab 248 of the outer slide 24. Therefore, the intermediate slide 20 can be completely pushed into the outer slide 24, together with the inner slide 28.

When the inner slide 28 is pulled outward, the rear end of the inner slide 28 does not press the actuating member 60 any more. Therefore, the actuating member 60 and the positioning member 40 are restored by the restoring force of the plate 42 of the positioning member 40. When the intermediate slide 20 is pulled outward, the sloping sides 444 of the positioning tabs 44 of the positioning member 40 slide along a surface of the locking tab 248 of the outer slide 24. The plate 42 of the positioning member 40 and the locking tab 248 are deformed. When the positioning tabs 44 slide over the locking tab 248, the positioning member 40 and the locking tab 248 are restored and the straight sides 442 of the positioning tabs 44 abut the distal end of the locking tab 248. At that position, the intermediate slide 20 can be pulled outward or kept at a certain position, but cannot be pushed inward any more.

In use, or before the inner slide is assembled, the arm 62 and/or the bridge 64 of the actuating member 60 can be pressed by a finger of a user to disengage the positioning tabs 44 of the positioning member 40 from the locking tab 248 of the outer slide 24. Then the intermediate slide 20 can be pushed inward.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-section slide assembly, comprising:

an outer slide comprising a web and two arms respectively extending from two lateral edges of the web, a locking tab formed on the web;

an intermediate slide received between the arms of the outer slide and being movable relative to the outer slide in a back-and-forth direction, the intermediate slide comprising a web and two arms respectively extending from two lateral edges of the web thereof, the web of the intermediate slide defining two receiving slots and at least one slit;

an actuating member mounted to the web of the intermediate member and forming two arms, two arrises protruding downward from the arms of the actuating member respectively and extending through the corresponding receiving slots of the intermediate slide to prevent the actuating member from moving along the intermediate slide in left-and-right direction;

a positioning member comprising a fixed end portion fixed to the intermediate slide and a free end portion being movable relative to the intermediate slide in an up-and-down direction perpendicular to the web of the intermediate slide, the free end portion pressing on a driving portion of the actuating member adjacent the arrises, the positioning member comprising at least one positioning tab extending from the free end portion through the at least one slit and abutting against the locking tab of the outer slide to prevent the intermediate slide from sliding inward in the back-and-forth direction; and an inner slide receivable and movable in the arms of the intermediate slide, the inner slide comprising a web and two arms respectively extending from two lateral edges of the web thereof, the inner slide capable of being slid relative to the intermediate slide inward to press the arms of the actuating member to allow the driving portion of the actuating member lifting the positioning member to thereby disengage the at least one positioning tab of the positioning member from the locking tab of the outer slide.

2. The multi-section slide assembly as described in claim 1, wherein the driving portion comprises two blocks respectively formed on adjacent ends of the arms of the actuating member, each of the blocks forms a pivot on an end thereof, the receiving slots of the intermediate slide are L-shaped and defined in an end of the intermediate slide, the blocks and the pivots are received in the corresponding receiving slots.

3. The multi-section slide assembly as described in claim 2, wherein each of the arms of the actuating member comprises an abutting portion, adjacent the corresponding block, each of the arrises protrudes downward from the corresponding block, the web of the intermediate slide comprises a bulge plate and two recessed lateral sides, the receiving slots are formed on the bulge plate, the abutting portions respectively abut against the corresponding recessed lateral sides of the web in the up-and-down direction.

4. The multi-section slide assembly as described in claim 3, wherein each of the abutting portions of the actuating member comprises an arcuate end, when the arms are pressed the arcuate ends roll on the corresponding recessed lateral side of the web to cause the actuating member pivoting around.

5. The multi-section slide assembly as described in claim 2, wherein the positioning member further comprises a plate, when the positioning member is mounted to the intermediate slide, the plate abuts against the web of the intermediate slide, the blocks, and the pivots of the actuating member.

6. The multi-section slide assembly as described in claim 5, wherein the plate of the positioning member defines a through hole, the web of the intermediate slide defines a fixing hole corresponding to the through hole of the positioning member, a rivet extends through the through hole of the positioning member, and into the fixing hole of the intermediate slide to engage with the intermediate slide.

7. The multi-section slide assembly as described in claim 1, wherein the actuating member comprises a bridge connecting two adjacent ends of the two arms away from the driving portion, and each of the arms of the actuating member forms an inclined surface, when the inner slide is slid inward the web of the inner slide presses and slides along the inclined surfaces of the arms, and presses the bridge of the actuating member to disengage the at least one positioning tab of the positioning member from the locking tab of the outer slide.

8. The multi-section slide assembly as described in claim 1, wherein the at least one positioning tab of the positioning member is triangle-shaped, and comprises a straight side and a sloping side, and the locking tab of the outer slide is sloping.

9. The multi-section slide assembly as described in claim 1, wherein the slide assembly further comprises at least one sliding-aiding member slidably mounted between the arms of the outer slide and the intermediate slide or between the arms of the intermediate slide and the inner slide, for facilitating the sliding movement of the intermediate slide relative to the outer slide or the sliding movement of the inner slide relative to the intermediate slide.

10. A multi-section slide assembly comprising:

an outer slide comprising a locking tab thereon;

an intermediate slide slidably received in the outer slide, the intermediate slide comprising a bulge plate, the bulge plate defining two receiving slots, and at least one slit;

a positioning member comprising one fixed end mounted to the bulge plate of the intermediate slide, and a free end forming at least one positioning tab therefrom to extend through the at least one slit of the intermediate slide and be blocked by the locking tab of the outer slide;

an actuating member comprising two arms and a bridge connecting adjacent ends of the two arms, two blocks extending inwardly from free ends of the arms and angled with the arms, the blocks received in the receiving slots of the intermediate slide, the positioning member located between the arms and biasing on the bulge plate and the blocks; and an inner slide slidable along the intermediate slide to depress the bridge of the actuating member thereby tilting the blocks, so that the blocks lift the at least one positioning tab to disengage from the locking tab of the outer slide.

11. The multi-section slide assembly as claimed in claim 10, wherein each of the blocks protrudes an arris at an underside thereof to be restrained by a lower edge of each of the receiving slots to prevent the actuating member from moving outwardly perpendicular to the lateral sides of the bulge plate.

12. A multi-section slide assembly comprising:

an outer slide comprising a locking member;

an intermediate slide slidably received in the outer slide and defining at least one slit;

an actuating member pivotably attached to the intermediate slide, and comprising a driven end portion and a driving end portion;

a positioning member comprising one fixed end portion fixed to the intermediate slide and a free end portion pressing on the driving end portion, the free end portion having at least one positioning tab extending therefrom through the at least one slit of the intermediate slide configured to be blocked by the locking member of the outer slide when the intermediate slide is slid in to a predetermined position; and an inner slide slidably received in the intermediate slide, the inner slide capable of being slid in to depress the driven end portion of the actuating member to pivot the actuating member which results in the driving end portion of the actuating member lifting the free end portion to disengage from the locking tab, whereby the intermediate slide is capable of being slid in over the predetermined position.

13. The multi-section slide assembly as claimed in claim 12, wherein the locking member comprises a cantilever tab extending slantly from the outer slide.

14. The multi-section slide assembly as claimed in claim 12, wherein the intermediate slide defines at least one slot, and the driving end portion of the actuating member comprises at least one block received in the at least one slot in such a manner that the driving end portion is movable in one direction perpendicular to sliding direction of the intermediate slide and is blocked in directions perpendicular to said one direction.

15. The multi-section slide assembly as claimed in claim 14, wherein the actuating member further comprises an abutting portion with an arcuate surface supported on the intermediate slide, when the driving end portion is pressed by the inner slide the arcuate surface rolls on the intermediate slide to cause the actuating member pivoting which results in the driving end portion of the actuating member being moved toward the inner slide in said one direction.

16. The multi-section slide assembly as claimed in claim 14, wherein the driven end portion of the actuating member comprises a pair of arms slantways positioned relative to the sliding direction of the inner slide, and the driving end portion comprises a pair of blocks formed at two adjacent ends of the arms respectively.

* * * * *